US012312195B2

(12) United States Patent
Yu

(10) Patent No.: US 12,312,195 B2
(45) Date of Patent: May 27, 2025

(54) ADHESIVE TAPE DISPENSER HAVING GUIDE FUNCTION

(71) Applicant: Yang Bey Industrial Co., Ltd., Taichung (TW)

(72) Inventor: Teng-Chi Yu, Taichung (TW)

( * ) Notice: Subject to any disclaimer, the term of this patent is extended or adjusted under 35 U.S.C. 154(b) by 112 days.

(21) Appl. No.: 18/198,827

(22) Filed: May 17, 2023

(65) Prior Publication Data

US 2024/0317531 A1 Sep. 26, 2024

(30) Foreign Application Priority Data

Mar. 22, 2023 (TW) ..... 112110706

(51) Int. Cl.
*B65H 35/00* (2006.01)

(52) U.S. Cl.
CPC ..... *B65H 35/0073* (2013.01); *B65H 35/004* (2013.01); *B65H 2402/41* (2013.01); *B65H 2402/53* (2013.01); *B65H 2701/377* (2013.01)

(58) Field of Classification Search
CPC ..... B65H 35/0073; B65H 35/004; B65H 35/0033; B65H 2402/41
USPC ..... 156/579
See application file for complete search history.

(56) References Cited

U.S. PATENT DOCUMENTS 10,815,093 B1 * 10/2020 Yu ..... B65H 35/0086

* cited by examiner

*Primary Examiner* — James D Sells
(74) *Attorney, Agent, or Firm* — Bruce Stone LLP; Joseph A. Bruce

(57) ABSTRACT

An adhesive tape dispenser having a guide function includes a handle, a retaining frame, a tape cutting unit, a guide unit, and a tape holding unit. The retaining frame is disposed on the handle. The retaining frame has a pair of vertical plates. The tape cutting unit has a roller and a blade that are located between the vertical plates. The guide unit has a pair of guide plates located outside the respective vertical plates. The guide plates each have a fastener for securing the guide plates to the respective vertical plates. The tape holding unit is configured to install an adhesive tape roll. Guide members of the guide plates are able to be in close contact with both sides of wooden planks, so as to achieve the effect of sticking the adhesive tape centrally.

6 Claims, 8 Drawing Sheets

ADHESIVE TAPE DISPENSER HAVING GUIDE FUNCTION

FIELD OF THE INVENTION

The present invention relates to an adhesive tape dispenser, and more particularly to an adhesive tape dispenser having a guide function.

BACKGROUND OF THE INVENTION

In general, adhesive tape is stuck on the top of a wooden plank for waterproofing or protection. A tape dispenser is used for applying the adhesive tape. A conventional adhesive tape dispenser has a handle and a retaining frame on the handle. The retaining frame includes a tape seat for installing an adhesive tape roll and a blade. The tape seat is configured to install the adhesive tape roll. The blade is configured to cut the adhesive tape roll, so as to complete the application of the adhesive tape.

The conventional adhesive tape dispenser is operated through the handle, so the adhesive tape applied to the wooden plank may be not centered. In addition to the problem of skewing, part of the wooden plank is exposed. The exposed wooden plank cannot be protected to cause damage. Accordingly, the inventor of the present invention has devoted himself based on his many years of practical experiences to solve these problems.

SUMMARY OF THE INVENTION

The primary object of the present invention is to provide an adhesive tape dispenser having a guide function, which can achieve the effect of sticking the adhesive tape centrally.

In order to achieve the aforesaid object, the adhesive tape dispenser of the present invention comprises a handle, a retaining frame, a tape cutting unit, a guide unit, and a tape holding unit. The retaining frame is disposed on the handle. The retaining frame has a pair of vertical plates. The tape cutting unit has a roller and a blade that are located between the vertical plates. The guide unit has a pair of guide plates located outside the respective vertical plates. The guide plates each have a fastener for fastening the guide plates to the respective vertical plates. The tape holding unit has a pressing member. The pressing member is connected to the vertical plates. The pressing member is configured to install an adhesive tape roll.

In the adhesive tape dispenser provided by the present invention, the guide members of the guide plates are able to be in close contact with both sides of wooden planks, so as to achieve the effect of sticking the adhesive tape centrally.

DETAILED DESCRIPTION OF THE PREFERRED EMBODIMENTS

Embodiments of the present invention will now be described, by way of example only, with reference to the accompanying drawings.

Figure 1:
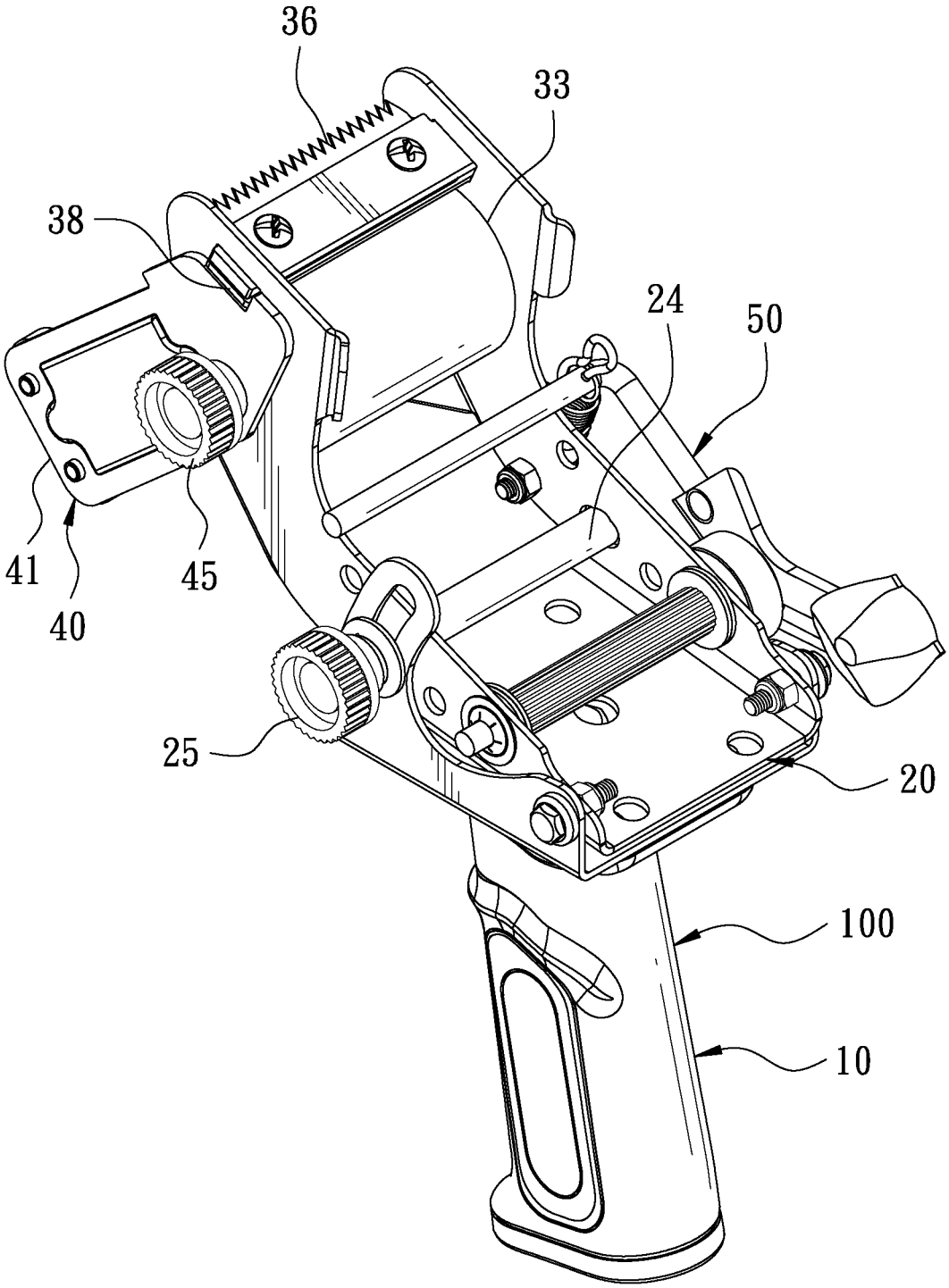
FIG. 1 is a perspective view in accordance with a preferred embodiment of the present invention.
Figure 2:
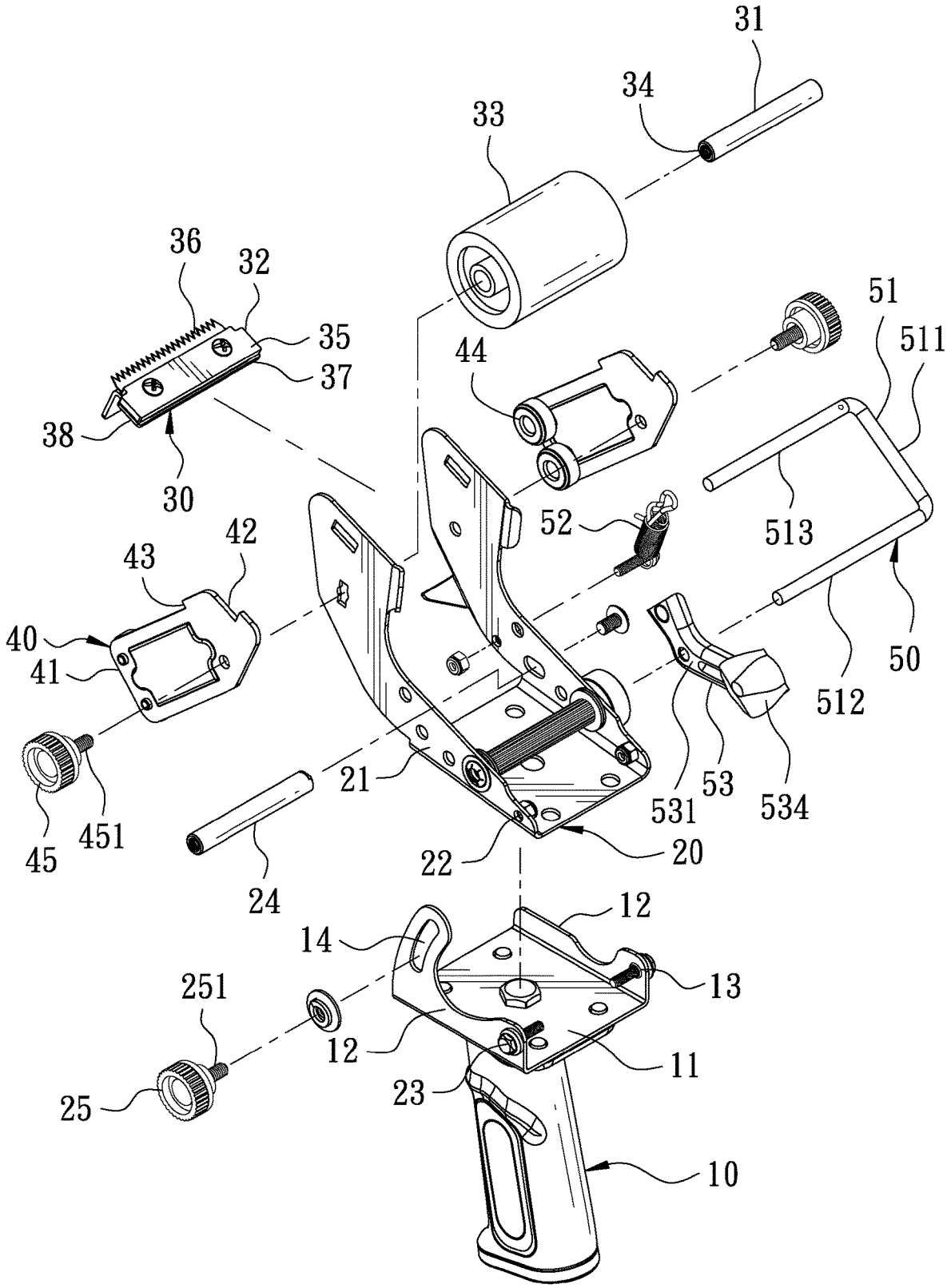
FIG. 2 is an exploded view in accordance with the preferred embodiment of the present invention.

FIG. 1 is a perspective view in accordance with a preferred embodiment of the present invention. FIG. 2 is an exploded view in accordance with the preferred embodiment of the present invention. The present invention discloses an adhesive tape dispenser 100 having a guide function. The adhesive tape dispenser 100 comprises a handle 10, a retaining frame 20, a tape cutting unit 30, a guide unit 40, and a tape holding unit 50.

The handle 10 includes an adjustment frame 11 and a pair of connecting plates 12 extending upwardly from the adjustment frame 10. Each connecting plate 12 has a pivot hole 13. One of the connecting plates 12 has an arc-shaped adjustment slot 14.

The retaining frame 20 has a pair of spaced vertical plates 21. The vertical plates 21 are located at the inner sides of the connecting plates 12, respectively. Each vertical plate 21 has a pivot hole 22. A pivot member 23 is insertedly connected to the pivot hole 13 of the handle 10 and the pivot hole 22 of the vertical plate 21. The pivot member 23 is composed of a screw and a sleeve, so that the retaining frame 20 can be pivoted. An adjustment axle 24 is provided between the vertical plates 21. An adjustment member 25 is provided on one end of the adjustment axle 24. The adjustment member 25 is a knob. The adjustment member 25 has a threaded portion 251 passing through the adjustment slot 14 and screwed to the adjustment axle 24. Thereby, the adjustment member 25 can be moved within the adjustment slot 14 to adjust the angle of the handle 10 in a stepless manner for applying the adhesive tape.

The tape cutting unit 30 has a spindle 31 and a blade holder 32 located between the vertical plates 21. A roller 33 is sleeved on the spindle 31. Either end of the spindle 31 has a screw hole 34. The blade holder 32 is located above the roller 33. The blade holder 32 has an upper holding plate 35, a blade 36 and a lower holding plate 37 that are sequentially arranged in a top-down direction and screwed together by a pair of screws. Two sides of the lower holding plate 37 under the blade fixing frame 32 have a pair of positioning portions 38 extending out of the outer sides of the vertical plates 21, respectively.

The guide unit 40 has a pair of guide plates 41 located outside the vertical plates 21, respectively. The outer peripheral wall of each guide plate 41 has an L-shaped first notch 42 and an L-shaped second notch 43. At least one guide member 44 is provided on the inner side of each guide plate 41. The guide member 44 may be a projection or a roller in any shape. In the embodiment of the present invention, the guide member 44 is a pair of rollers. A fastener 45 is insertedly connected to each guide plate 41. The fastener 45 is a knob. The fastener 45 has a threaded portion 451 passing through the corresponding vertical plate 21 and screwed to the corresponding end of the spindle 31, so that the guide plates 41 are secured to the vertical plates 21, respectively. Each guide plate 41 may be in a rotatable unlocked state or a non-rotatable locked state. The user can position the first notch 42 or the second notch 43 of the guide plate 41 on the positioning portion 38 according to the needs, or position the guide plate 41 at any position, and then fasten the fastener 45 to lock the guide plate 41. In other implementations, the threaded portion 451 of the fastener 45 may be screwed to the corresponding vertical plate 21, which also allow each guide plate 41 to be in a rotatable unlocked state or a non-rotatable locked state.

Figure 3:
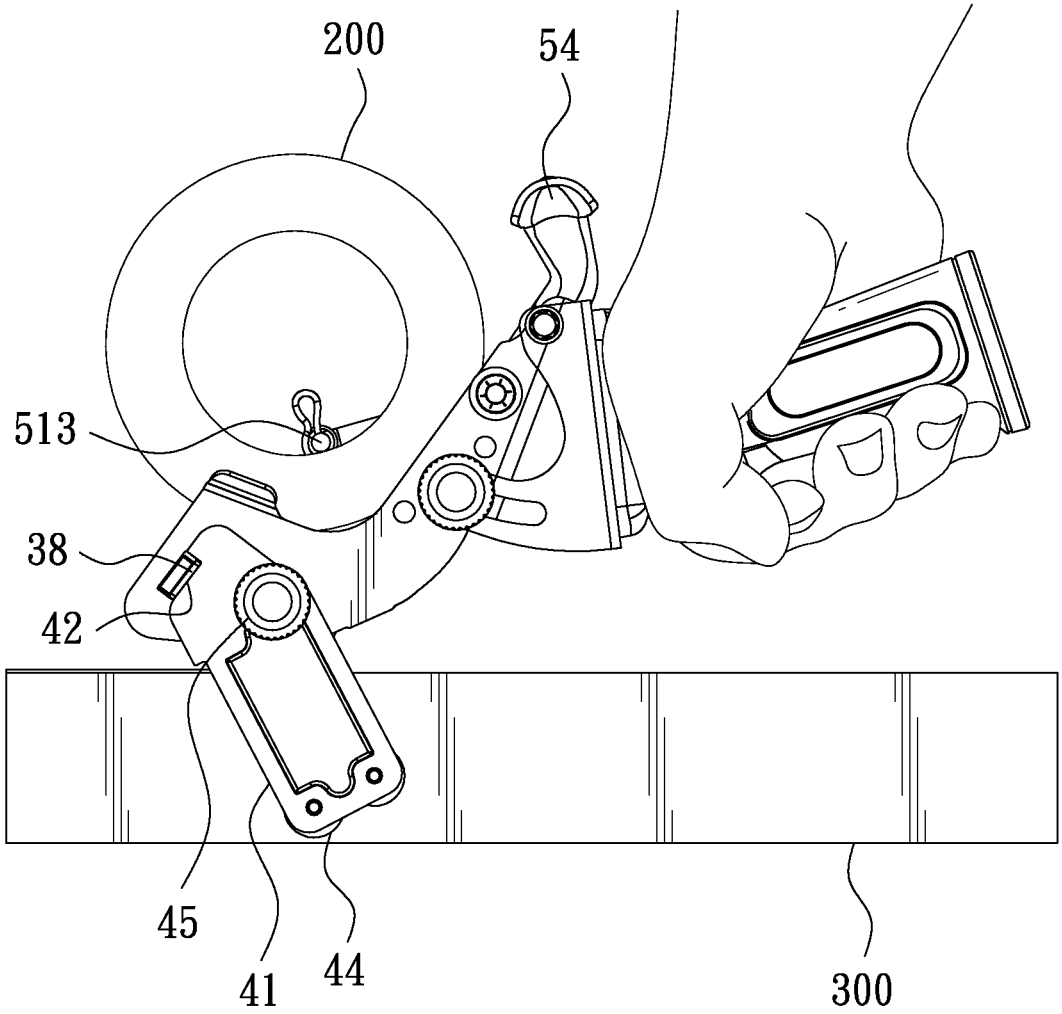
FIG. 3 is a schematic view in accordance with the preferred embodiment of the present invention when in use.
Figure 7:
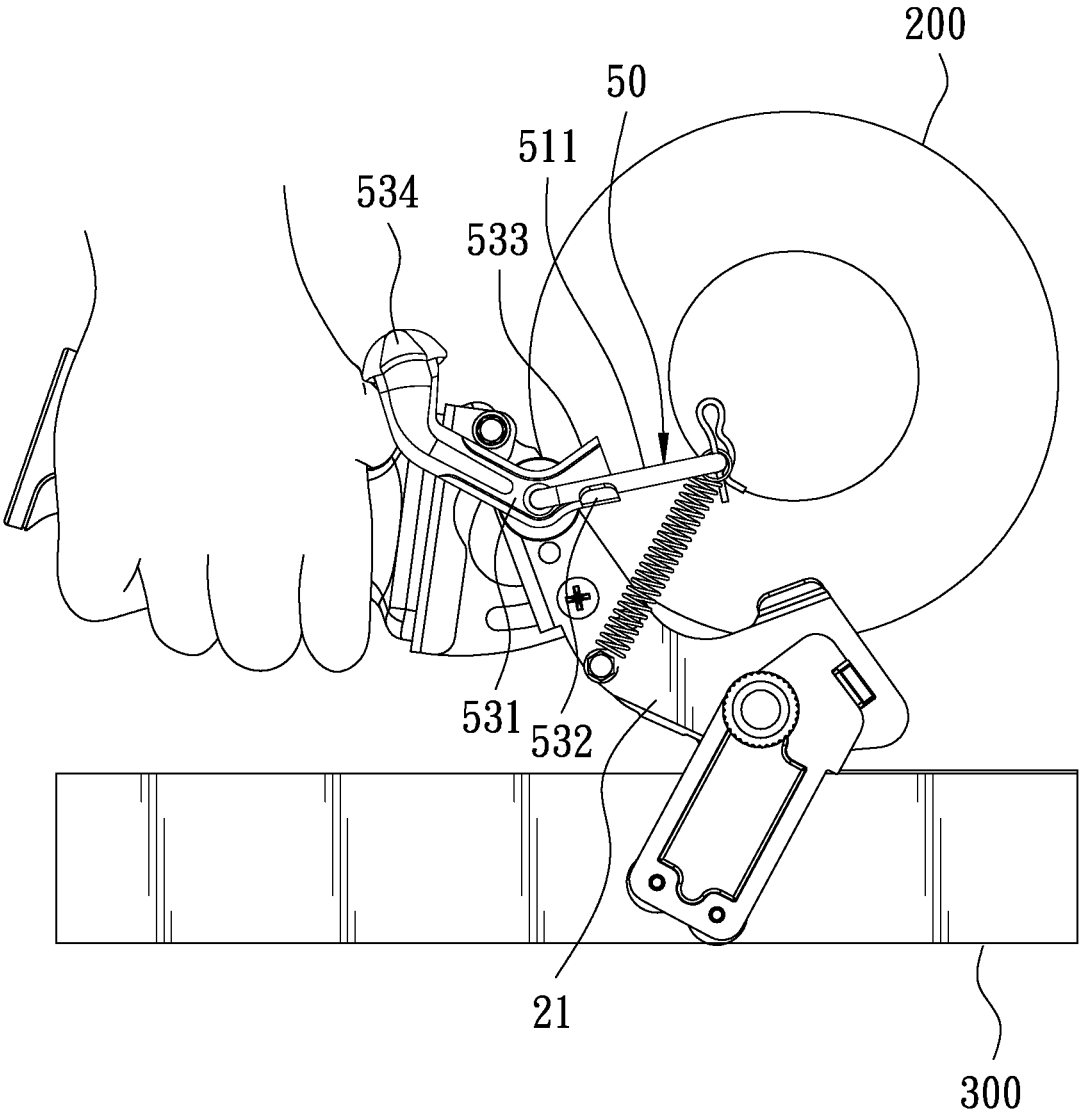
FIG. 7 is a schematic view in accordance with the preferred embodiment of the present invention when in use, illustrating that the press plate touches the user's hand.

The tape holding unit 50 has a pressing member 51, a spring 52, and an operating member 53. The pressing member 51 includes a drive rod 511. Both ends of the drive rod 511 are bent in the same direction and extend to form a pivot rod 512 and a pressing rod 513. The pivot rod 512 is pivotally connected to the vertical plates 21. The pressing rod 513 is configured to hold an adhesive tape roll 200. As shown in FIG. 3, one end of the spring 52 is connected to the vertical plate 21, and the other end of the spring 52 is sleeved on the pressing rod 513. The pressing rod 513 is pressed against the adhesive tape roll 200 via the elastic force of the spring 52, so as to improve the stability of the adhesive tape dispenser 100 when in use and avoid shaking. The operating member 53 has an operating plate 531. The pivot rod 512 is inserted through the operating plate 531. Two sides of one end of the operating plate 531 extend outwardly to form a C-shaped drive plate 532 and a stop plate 533, respectively. As shown in FIG. 7, the drive rod 511 is located between the drive plate 532 and the stop plate 533. The other end of the operating plate 531 has a press plate 534.

Please refer to FIG. 3 and FIG. 7. When the user intends to use the adhesive tape dispenser 100, he/she has to press the press plate 534 first for rotating the operation plate 531. The drive rod 511 is driven by the drive plate 532 to rotate, so that the pressing rod 513 is moved away from the vertical plates 21. The pressing rod 513 is mounted with the adhesive tape roll 200. Then, the position of the guide plates 41 is adjusted by the fasteners 45. In the embodiment of the present invention, the first notches 42 of the guide plates 41 are positioned on the respective positioning portions 38. The fasteners 45 are fastened so that the guide plates 41 cannot rotate. At this time, the guide members 44 of the guide plates 41 are close contact with to both sides of a wooden plank 300, and the user holds the handle 10 to stick the adhesive tape to the wooden plank 300, so as to achieve the effect of sticking the adhesive tape centrally. Finally, the adhesive tape is cut off by the blade 36 of the tape cutting unit 30 to complete the application of the adhesive tape. After use, the second notches 43 of the guide plates 41 are positioned on the positioning portions 38 respectively, so that the blade 36 is positioned between the guide plates 41 to avoid touching the blade 36 accidentally.

Figure 4:
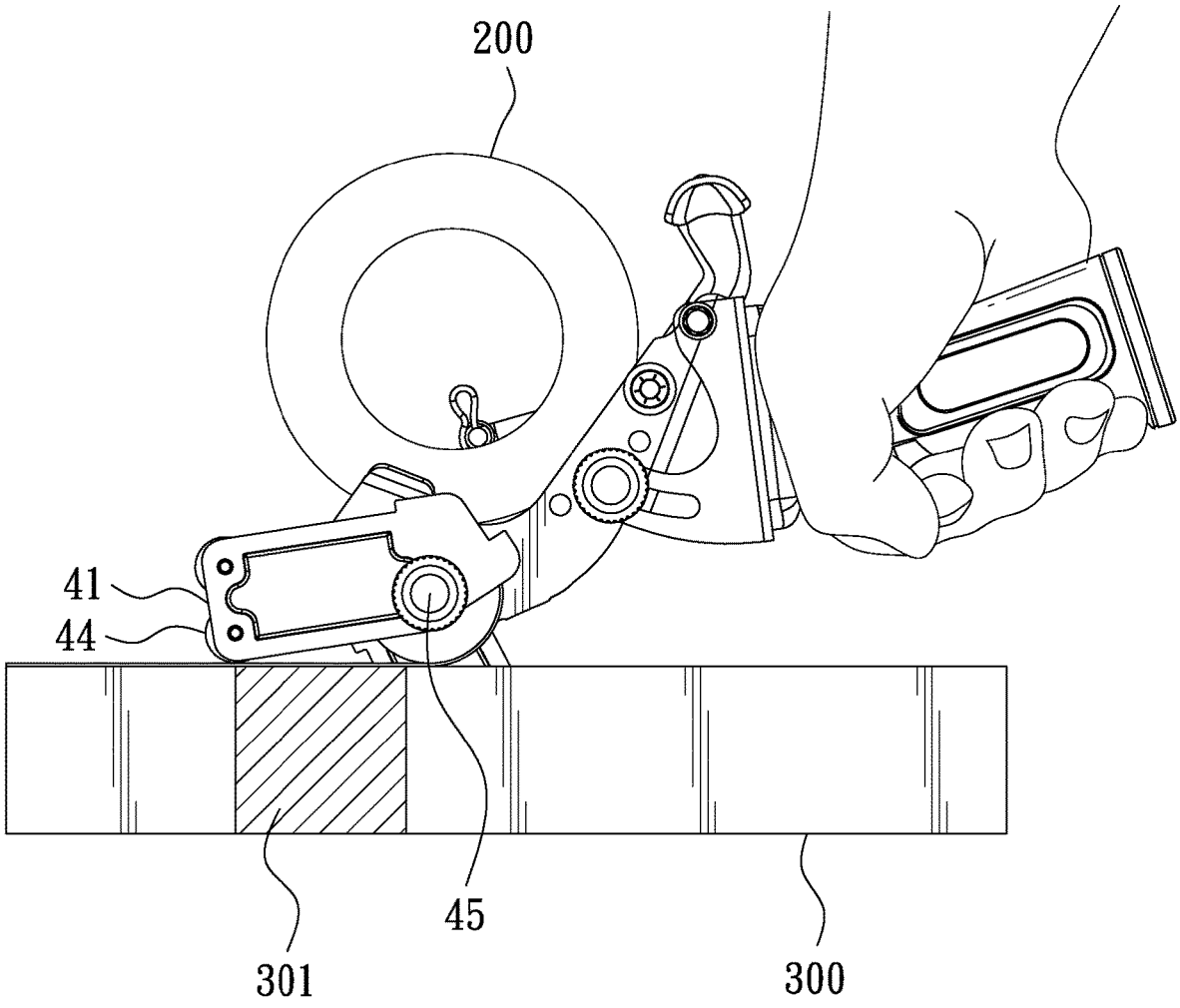
FIG. 4 is a schematic view in accordance with the preferred embodiment of the present invention when in use, illustrating the guide plates to straddle wooden planks.

Please refer to FIG. 4. When the adhesive tape is to be attached to a frame formed by a plurality of wooden planks 300 assembled vertically, the user can loosen one of the fasteners 45 first for the guide members 44 of the guide plates 41 to be in close contact with both sides of the wooden planks, so as to achieve the effect of sticking the adhesive tape centrally. Alternatively, the guide plates 41 may be secured above and under the retaining frame 20, respectively. The guide plate 41 secured under the retaining frame 20 is in close contact with one side of the wooden planks to achieve the effect of one-sided alignment. In addition, if the guide plates 41 are secured above the retaining frame 20, the adhesive tape dispenser functions as a general adhesive tape dispenser.

Figure 5:
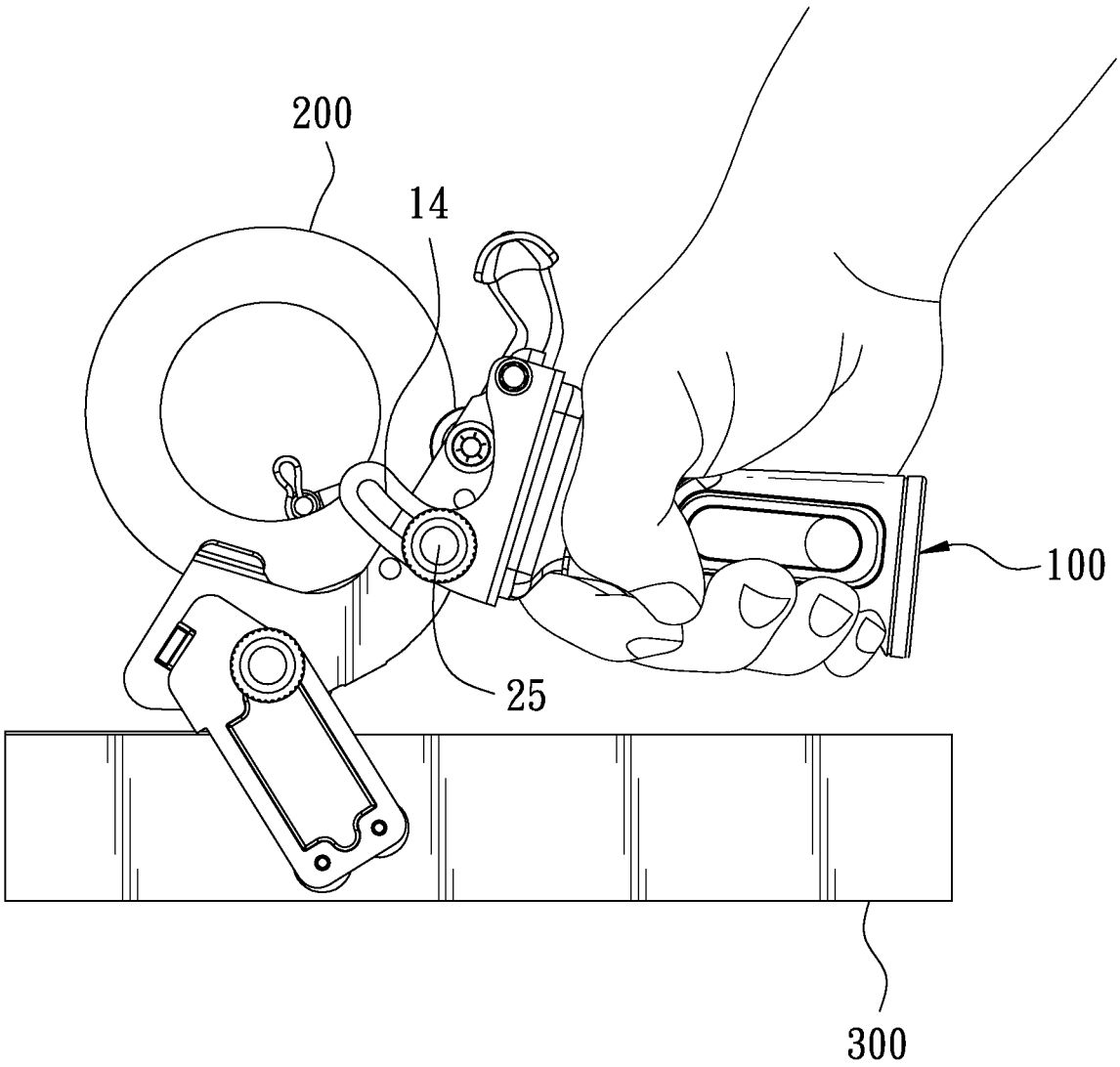
FIG. 5 is a schematic view in accordance with the preferred embodiment of the present invention when in use, illustrating that the angle of holding the adhesive tape dispenser is adjustable.
Figure 6:
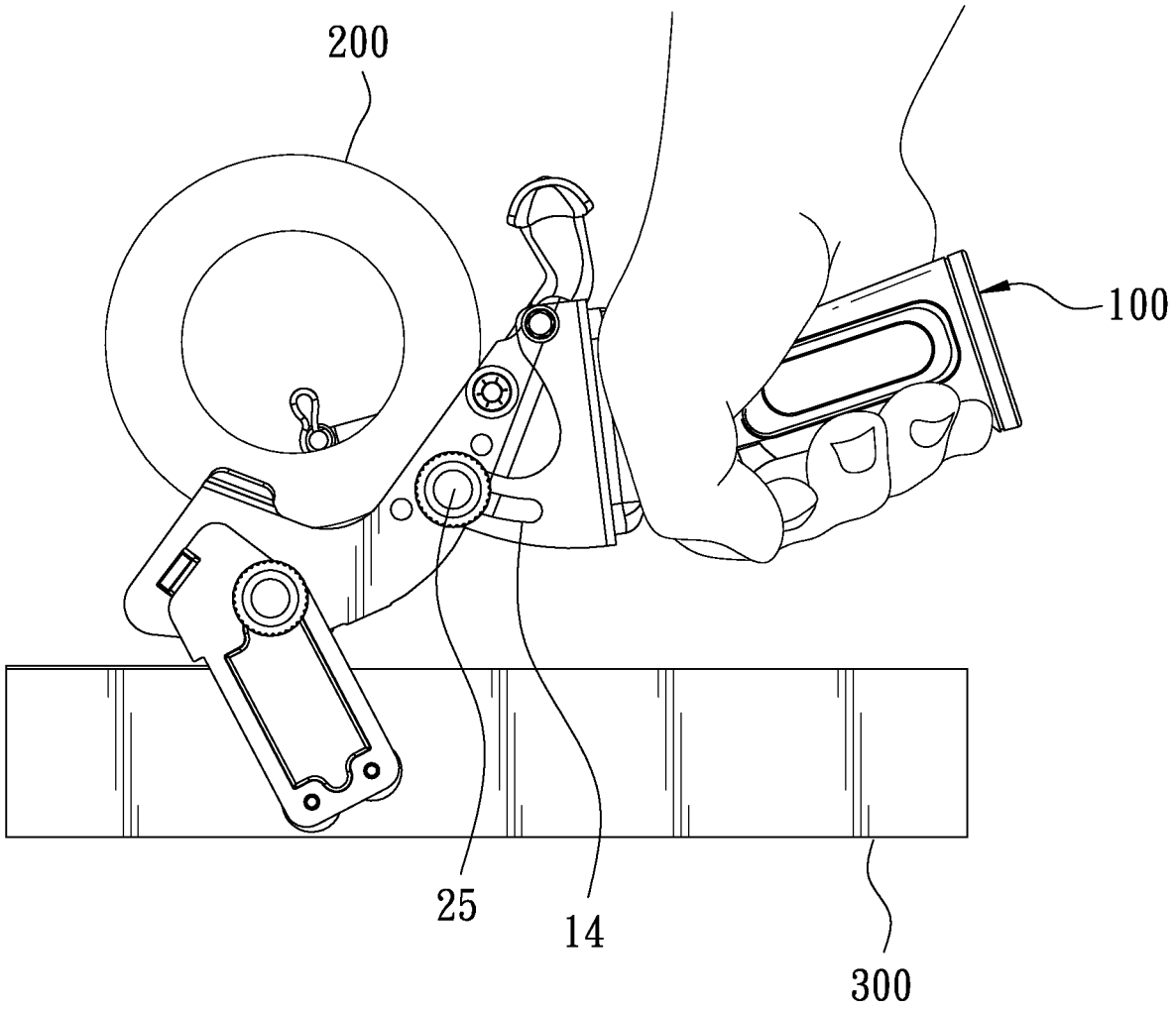
FIG. 6 is a schematic view in accordance with the preferred embodiment of the present invention when in use, illustrating that the angle of holding the adhesive tape dispenser is adjustable.

According to the standing posture, squatting posture or the angle of holding the adhesive tape dispenser, the user can freely adjust the angle to hold the handle comfortably for applying the adhesive tape by adjusting the adjustment member 25 within the adjustment slot 14, as shown in FIG. 5 and FIG. 6.

Figure 8:
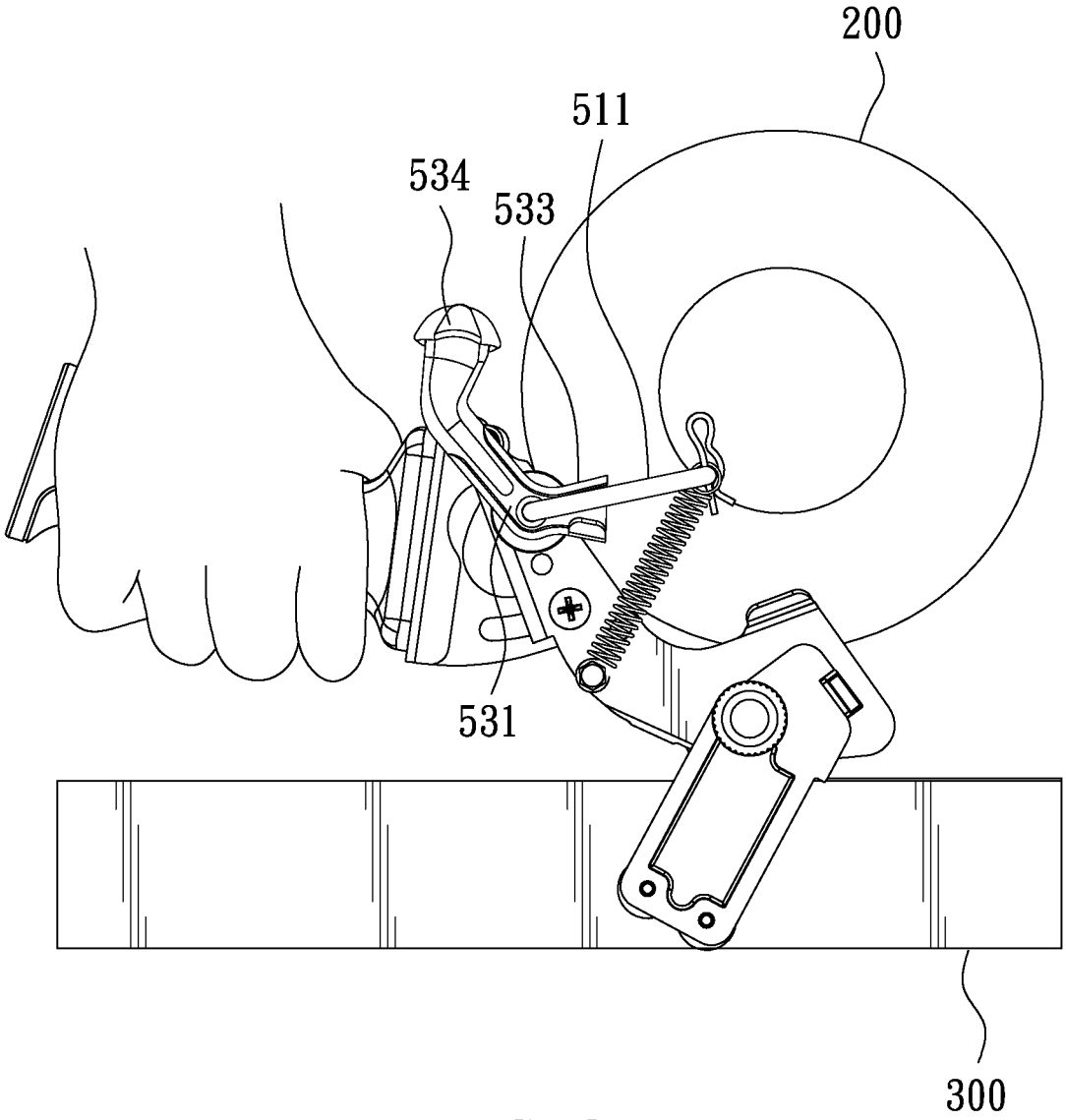
FIG. 8 is a schematic view in accordance with the preferred embodiment of the present invention when in use, illustrating that the press plate is pulled upwards.

When the pressing rod 513 of the tape holding unit 50 is mounted with a larger adhesive tap roll 200, as shown in FIG. 7, the press plate 534 will touch the back of the user's hand, causing inconvenience to the user. The user can pull the press plate 534 upwards, as shown in FIG. 8, for the drive rod 511 to abut against the stop plate 533, so that the press plate 534 will not touch the back of the user's hand.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An adhesive tape dispenser having a guide function, comprising:

a handle;

a retaining frame, disposed on the handle, the retaining frame having a pair of vertical plates;

a tape cutting unit, having a roller and a blade that are located between the vertical plates;

a guide unit, having a pair of guide plates located outside the respective vertical plates, the guide plates each having a fastener for fastening the guide plates to the respective vertical plates;

a tape holding unit, having a pressing member, the pressing member being connected to the vertical plates, the pressing member being configured to install an adhesive tape roll; and the tape cutting unit has a spindle, the spindle is located between the vertical plates, the roller is sleeved on the spindle, either end of the spindle has a screw hole, the fastener is a knob, the fastener has a threaded portion, and the threaded portion of the fastener is screwed to the corresponding end of the spindle for the guide plates to be in a rotatable unlocked state or a non-rotatable locked state.

2. The adhesive tape dispenser as claimed in claim 1, wherein the vertical plates each have a positioning portion on an outer side thereof, and the guide plates each have a first notch and a second notch.

3. The adhesive tape dispenser as claimed in claim 1, wherein at least one guide member is provided on an inner side of each of the guide plates.

4. The adhesive tape dispenser as claimed in claim 1, wherein the handle includes an adjustment frame and a pair of connecting plates extending upwardly from the adjustment frame, one of the connecting plates has an arc-shaped adjustment slot, the retaining frame is pivotally connected to the adjustment frame, the vertical plates are located at inner sides of the connecting plates respectively, an adjustment axle is provided between the vertical plates, an adjustment member is provided on one end of the adjustment axle, the adjustment member has a threaded portion passing through the adjustment slot and screwed to the adjustment axle.

5. The adhesive tape dispenser as claimed in claim 1, wherein the pressing member includes a drive rod, two ends of the drive rod are bent in a same direction and extend to form a pivot rod and a pressing rod, the pivot rod is pivotally connected to the vertical plates, the pressing rod is configured to install the adhesive tape roll, the tape holding unit further includes a spring, one end of the spring is connected to the vertical plate, and another end of the spring is sleeved on the pressing rod.

6. The adhesive tape dispenser as claimed in claim 5, wherein the tape holding unit further includes an operating member, the operating member has an operating plate, the pivot rod is inserted through the operating plate, two sides of one end of the operating plate extend outwardly to form a drive plate and a stop plate respectively, the drive rod is located between the drive plate and the stop plate, and another end of the operating plate has a press plate.

* * * * *